US009840888B2

(12) United States Patent
Angman et al.

(10) Patent No.: US 9,840,888 B2
(45) Date of Patent: Dec. 12, 2017

(54) DOWNHOLE TOOL HAVING A SHOCK-ABSORBING SLEEVE

(71) Applicant: KOBOLD SERVICES INC., Calgary (CA)

(72) Inventors: Per Angman, Calgary (CA); Kevin Graf, Calgary (CA); Chris Baudistel, Didsbury (CA); Mark Andreychuk, Calgary (CA)

(73) Assignee: Kobold Corporation, Calgary (CA)

( * ) Notice: Subject to any disclaimer, the term of this patent is extended or adjusted under 35 U.S.C. 154(b) by 407 days.

(21) Appl. No.: 14/328,422

(22) Filed: Jul. 10, 2014

(65) Prior Publication Data

US 2015/0013991 A1 Jan. 15, 2015

Related U.S. Application Data

(60) Provisional application No. 61/844,664, filed on Jul. 10, 2013.

(51) Int. Cl.
*E21B 34/06* (2006.01)
*E21B 34/00* (2006.01)
*E21B 17/07* (2006.01)

(52) U.S. Cl.
CPC ..... *E21B 34/06* (2013.01); *E21B 17/07* (2013.01); *E21B 2034/007* (2013.01)

(58) Field of Classification Search
CPC ..... E21B 17/07; E21B 34/06; E21B 2034/007
USPC ..... 175/321
See application file for complete search history.

(56) References Cited

U.S. PATENT DOCUMENTS 2,516,782 A * 7/1950 Magrum ..... F16F 9/34 137/493.8
3,949,150 A * 4/1976 Mason ..... E21B 17/07 175/321
3,998,443 A * 12/1976 Webb ..... E21B 17/073 175/322
4,220,173 A * 9/1980 O'Brien ..... F15B 21/02 137/239

FOREIGN PATENT DOCUMENTS

EP 0489527 A1 * 6/1992 ..... E21B 17/07

* cited by examiner

*Primary Examiner* — Giovanna C Wright
*Assistant Examiner* — Manuel C Portocarrero
(74) *Attorney, Agent, or Firm* — Parlee McLaws LLP; Sean Goodwin; Linda Thompson

(57) ABSTRACT

An apparatus having a shock-absorbing sleeve is disclosed. The apparatus comprises a housing, an axially moveable sleeve received in the housing and a sealed annular space having a fixed volume axially between the housing and the sleeve. A barrier axially moveable with the sleeve divides the annular space into a first and a second chambers. The first and second chambers are filled with uncompressible dampening fluid. One or more metering passages across the barrier fluidly connect the first and chambers. During the axial movement of the sleeve, the volume of the first chamber is reduced and that of the second chamber is increased, forcing the fluid in the first chamber to flow into the second chamber in a controlled manner to dampen the movement of the sleeve.

21 Claims, 18 Drawing Sheets

SLEEVE – CLOSE POSITION

SLEEVE – CLOSE POSITION

SLEEVE – OPEN POSITION

SLEEVE – CLOSE POSITION

SLEEVE – CLOSE POSITION

SLEEVE – CLOSE POSITION

DOWNHOLE TOOL HAVING A SHOCK-ABSORBING SLEEVE

FIELD

Embodiments herein are related to a shock-absorbed sleeve in downhole tool deployed in a wellbore, and more particularly to apparatus and method of absorbing or dampening damaging effects resulting from the actuation of a shifting sleeve during downhole operations.

BACKGROUND

Shifting sleeves are incorporated into tubulars, such as casing and completion strings. Generally the sleeves are fit to a tool for selectively opening ports through the casing during wellbore completion operations. Typically completion tools, including a shifting tool, are run into the wellbore and located at the sleeve. The shifting tools engaged the sleeve and an axial actuating force is applied to the sleeve to shift the sleeve. The sleeve is initially restrained to the casing using shear screws. The actuating force overcomes the shear screws and is released to move downhole, shifting the sleeve to the actuated position. The movement of the sleeve is arrested by a mechanical stop between the sleeve and the casing.

The initiation and arresting of the movement of sleeve create sufficient forces to damage the sleeve, the shifting tool, and even the cased wellbore environment. It has been observed that the impact force as the sleeve reaches the stop is sufficient to cause a variety of damage. For example, where the shifting tool engages the sleeve using anchors, slips having teeth, wickers or the like thereon, can significantly damage the inside surface of the sleeve when subjected to such actuation forces. When the sleeve suddenly stops, the inertia in the moving components, such as the shifting tool and supporting string, results in large forces at the slip/sleeve interface. Damage results, detrimental to the integrity of the related components and environment including the sleeve, the shifting tool, the downhole tool incorporating the sleeve and the near wellbore.

With reference to FIGS. 1A and 1B, a conventional prior art, resettable sealing device 10 is shown with an anchor comprising button-type slip inserts 12. The resettable sealing device 10 was positioned in a prior art sleeve 14 fit to a prior art sleeve sub, which was in turn incorporated in a casing. Other types of slips 13 having alternate forms of slip inserts or wickers formed thereon were also tested. To test the energy of sleeve actuation, the resettable sealing device 10 was anchored within the sleeve and accelerometers were positioned on casing for detecting the shock resulting from the shifting of the sleeve. The resettable sealing device 10 was actuated by the cone 15 driving slips 13 outwardly to engage inserts 12 onto the sleeve 14. Pressure at the resettable sealing device was increased to impart an actuating force on the sleeve, shearing shear screws, and shifting the sleeve to an actuated position. The movement of the sleeve was arrested against a stop shoulder in the sleeve sub.

As shown in the diagrammatic representation of actual photographs set forth in FIGS. 2 and 3, the sudden stop of the sleeve and device 10 resulted in significant loads therebetween. As shown, the forces caused the inserts 12 to bite further into the inner surface of the sleeve, leaving crescent shaped cuts 18 in the inner wall of the sleeve 14. Subsequent sleeve re-engagement is compromised. Further, the high impact to the sleeve also caused failure of the anchor in some tests including to the slips and slips retaining structure.

Some prior art sleeve shifting systems appear to be purposefully designed to create very high arresting forces resulting in positive indications of sleeve actuation that can be verified at surface. Such systems are particularly at risk of damaging the sleeves and completion tools as a result. Further, there are concerns that the shock loading can result in shock damage to the wellbore environment including the zonal isolation cement and even the formation therebeyond.

Therefore, there is a need for a method for lessening the shock loading during sleeve actuation so as minimize the risk of damaging the downhole apparatus and wellbore during wellbore completion operations.

SUMMARY

According to one aspect of this disclosure, there is provided a downhole apparatus comprising: a tubular housing along a tubing string; a sleeve located within the housing and axially moveable therein from a first position to a second position; and a first annular chamber radially intermediate the housing and the sleeve, said first annular chamber containing a first dampening fluid and being capable of controllably releasing the first dampening fluid under pressure; wherein when the sleeve moves from the first position to the second position, the first dampening fluid is pressurized and controllably released for controlling the speed of the sleeve movement.

In some embodiments, the first dampening fluid is a substantially incompressible fluid such as grease.

In some embodiments, the first dampened fluid has a viscosity index in the range between 80 and 110. In some embodiments, the first dampened fluid has a viscosity index of 90.

In some embodiments, the downhole apparatus may further comprise a second annular chamber radially intermediate the housing and the sleeve, and axially immediately adjacent the first annular chamber; wherein the second annular chamber is in fluid communication with the first chamber for receiving the first dampening fluid released from the first chamber. The second chamber may contain a second dampening fluid. The first and second dampening fluid may be the same fluid, or alternatively may be different fluids.

In some embodiments, the first and second chambers are formed from an annular space radially intermediate the housing and the sleeve. An annular barrier divides the annular space into the first and second chambers.

In some embodiments, the annular space is located at a fixed location with respect to the housing, and the annular barrier is fixed to the sleeve and moveable therewith, the movement of the annular barrier simultaneously reducing the volume of the first chamber and enlarging the volume of the second chamber.

In some embodiments, the barrier comprises a seal arrangement for sealing between the sleeve and the housing.

In some embodiments, the barrier is threadably engaged along the sleeve.

In some embodiments, the annular space is located at a fixed location with respect to the sleeve and moveable therewith, and the annular barrier is located at a fixed location with respect to the housing, the movement of the annular barrier simultaneously reducing the volume of the first chamber and enlarging the volume of the second chamber.

In some embodiments, the downhole apparatus further comprises at least one metering passage fluidly connecting the first and second chambers across the barrier. The at least one metering passage may extend axially through the interface of the sleeve and the barrier on both sides thereof or on either side thereof. Alternatively, the at least one metering passage may extend axially through the barrier.

In some embodiments, the sleeve comprises exterior threads and the barrier comprises internal threads, the sleeve's exterior threads being circumferentially discontinuous forming at least one axial metering passage fluidly connecting the first and second chambers across the barrier. The barrier's internal threads may also be circumferentially discontinuous forming at least one axial metering passage fluidly connecting the first and second chambers across the barrier. Therefore, the at least one metering passage may be formed by the discontinuity of the sleeve's exterior threads, the discontinuity of the barrier's internal threads, or both.

In some embodiments, the housing comprises a shoulder for receiving an annular end surface of the sleeve when the sleeve is at the second position, wherein the annular end surface of the sleeve extends axially outwardly with a predefined angle from an inner edge thereof to an outer edge thereof, and wherein the shoulder of the housing extends axially inwardly with the predefined angle from an inner edge thereof to an outer edge thereof.

According to another aspect of this disclosure, there is provided a method of moving a sleeve in a housing axially from a first position to a second position, said housing being used in a tubing string, said method comprising: providing a first annular chamber radially intermediate the housing and the sleeve; enclosing a first dampening fluid in the first chamber; moving the sleeve from the first position to the second position; and, during the movement of the sleeve, pressurizing the first dampening fluid in the first chamber, and controllably releasing the pressurized first dampening fluid out of the first chamber for controlling the speed of the sleeve.

In some embodiments, the method further comprises providing a second annular chamber radially intermediate the housing and the sleeve, and axially immediately adjacent the first annular chamber, wherein the second annular chamber is in fluid communication with the first chamber; and receiving, in the second chamber, controlled release of fluid out of the first chamber during the movement of the sleeve.

According to yet another aspect of this disclosure, there is provided a method of moving a sleeve in a housing axially from a first position to a second position, said housing being used in a tubing string, said method comprising: providing a closed annular space radially intermediate the housing and the sleeve; dividing the annular space into a first and a second chambers in fluid communication; enclosing incompressible fluid in the first and second chambers; moving the sleeve from the first position to the second position; and, during the movement of the sleeve, simultaneously reducing the volume of the first chamber and increasing the volume of the second chamber to pressurize the fluid in the first chamber and force the fluid in the first chamber to controllably flow into the second chamber for dampening the sleeve's movement.

DETAILED DESCRIPTION

Figure 1A:
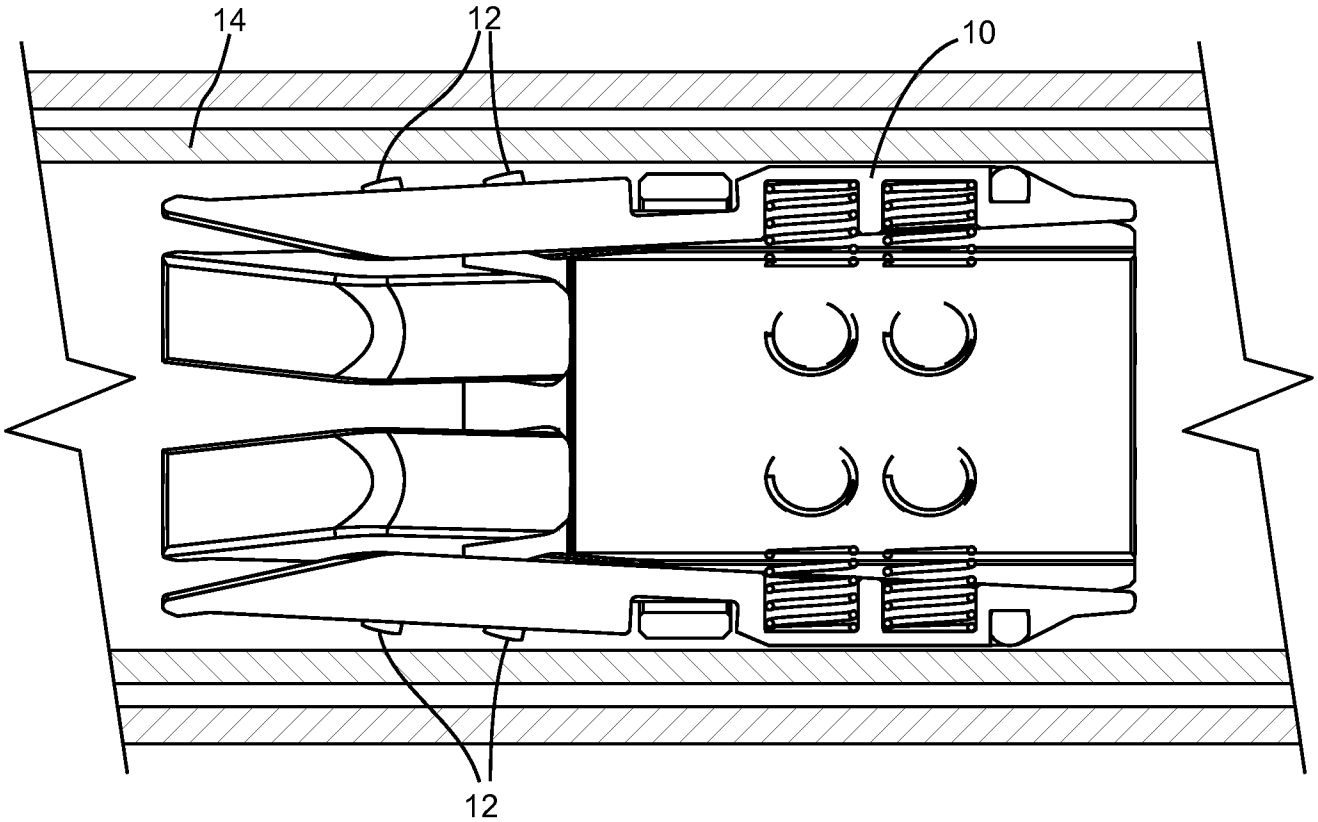
FIG. 1A Prior Art
FIGS. 1A and 1B show a partial side view of a prior art resettable sealing device for a sleeve shifting tool, the device having slip inserts for engaging an inside surface of the sleeve.
Figure 1B:
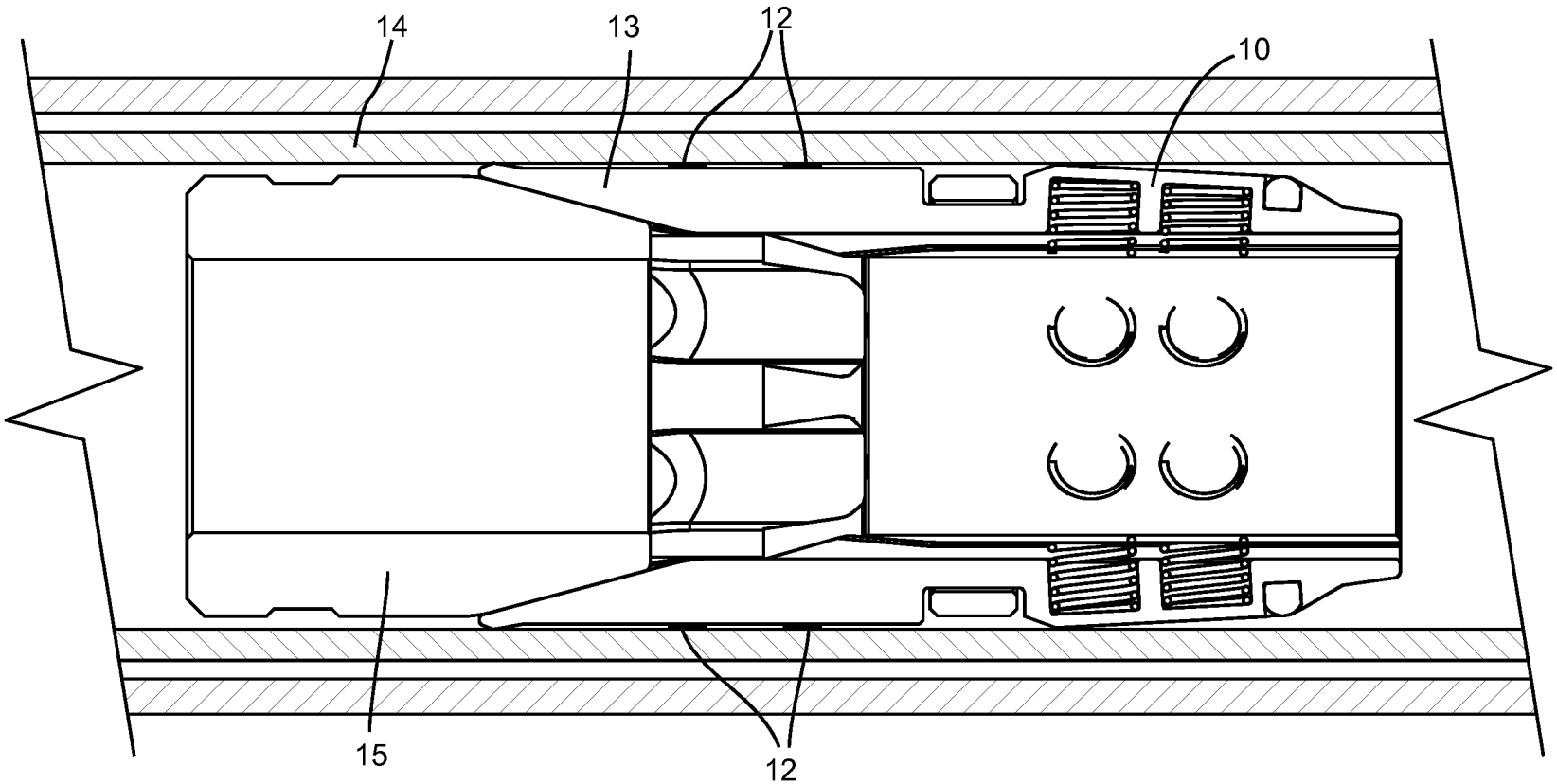
FIG. 1B Prior Art
Figure 3:
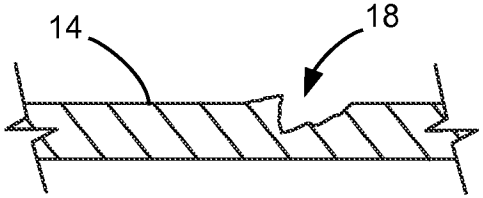
FIG. 3 Prior Art
FIGS. 2 and 3 shows representations of photographic evidence of damage to an inside wall of a prior art sleeve caused in a test actuation using slip inserts according to FIGS. 1A and 1B, FIG. 2 illustrating a cross-section of a sleeve showing pairs of slip scoring and FIG. 3 showing a closed up cross-section of the sleeve wall of FIG. 2 having a piled-up landing area of one insert.
Figure 2:
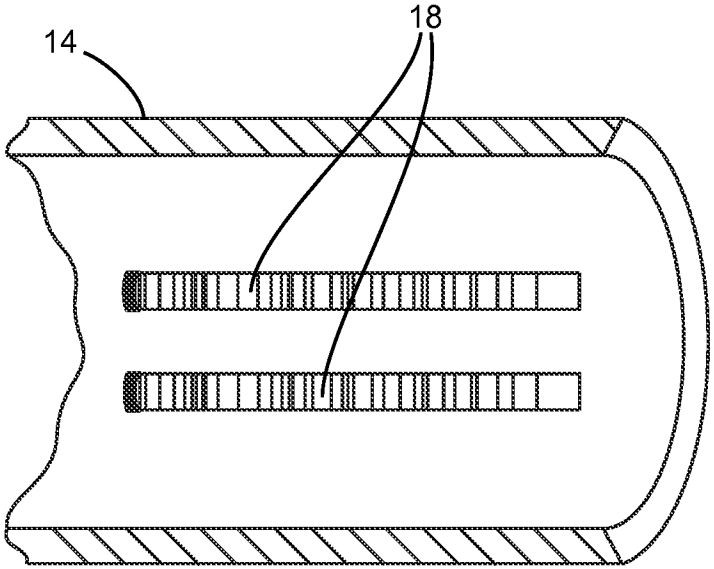
FIG. 2 Prior Art

Having reference to one embodiment of a shock-absorbing sleeve shown in FIGS. 4A to 5B, a sleeve sub 102 is provided having a shifting or sliding sleeve 114 and a closed or sealed annular space filled with substantially incompressible dampening fluid such as grease. A shock absorbing barrier ring 122 divides the annular space into at least a first and a second chambers 126 and 128 in fluid communication via one or more metering passages. When the sleeve 114 is moving from a first position downhole to a second position, the volume of the first chamber 126 is reduced and that of the second chamber 128 is increased, pressurizing the fluid in the first chamber 126 and forcing it to flow into the second chamber via the metering passages in a controlled manner. The pressurization of the fluid in the first chamber 126 and the controllable release of the fluid out of the first chamber 126 absorbs the momentum of the moving sleeve 114 and controls the speed of the sleeve movement. The arresting action caused by stopping of the sleeve is reduced.

A plurality of sleeve subs 102 are typically spaced along a casing or completion string to access various locations along a wellbore. One or more of the sleeve subs 102 are actuated for various operations.

As shown, each sleeve sub 102 comprises a cylindrical, tubular housing 108. An uphole and a downhole tubular collar 108A and 108B are threaded into the uphole and downhole ends of the housing 108, respectively, for connection inline within the completion string (not shown). The uphole and downhole tubular collar 108A and 108B have an inner diameter smaller than the inner diameter of the housing 108. The downhole collar 108B comprises a shoulder or sleeve stop 112 for delimiting the downhole movement of the sleeve 114.

The shifting sleeve 114 is a cylindrical tubular received within the housing 108 and axially moveable therewithin during operation between a first, uphole and a second, downhole position. In particular, the shifting sleeve 114 has an outer diameter generally the same as or slightly smaller than the uphole and downhole collar 108A and 108B such that the uphole and downhole ends 116 and 118 of the shifting sleeve 114 are slidably received in the uphole and downhole collar 108A and 108B, respectively, and axially moveable therewith. The sleeve 114 is retained concentrically within housing 108 and guided during axial movement by the uphole and downhole collars 108A and 108B.

While the sleeve sub can have various functions, typically a sleeve sub 102 is ported and the sleeve 114 is actuated to open or close ports to control communication from a bore of the completion string to the wellbore without and the formation therebeyond.

Figure 4A:
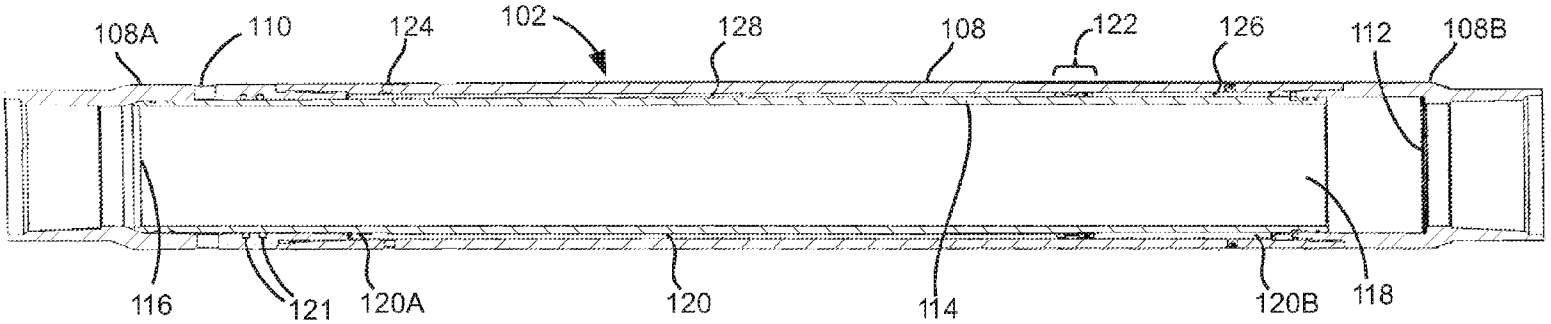
FIG. 4A is a cross-sectional view of a ported-form of sleeve sub having an axially moveable sleeve shown in the initial uphole or port-closed position, according to an embodiment disclosed herein.
Figure 5A:
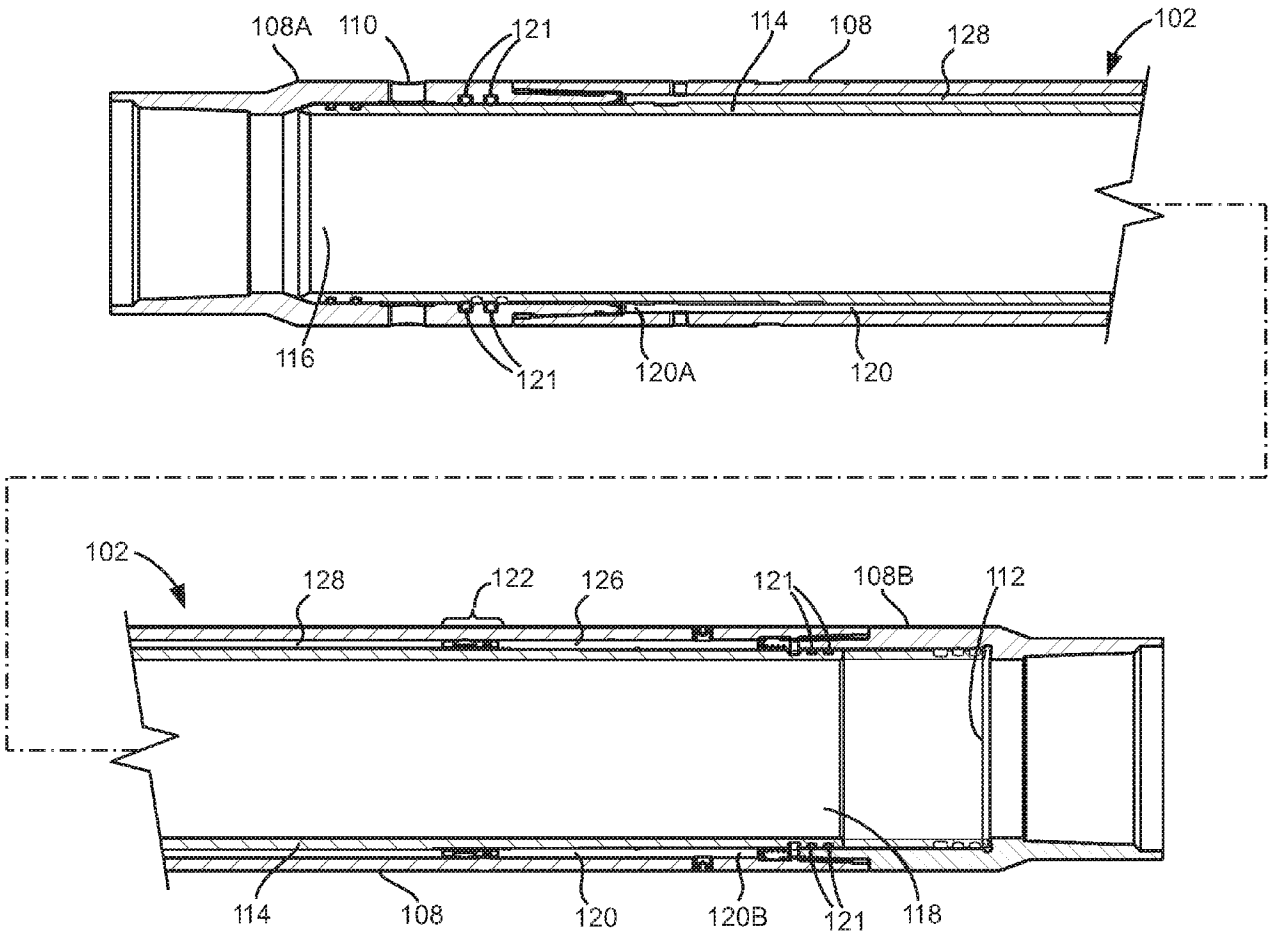
FIG. 5A illustrates more detailed partial sectional views of an uphole port end and downhole stop end of the sleeve sub of FIG. 4A with the sleeve in the closed position.

Accordingly, in this embodiment, the sleeve sub 102 further comprises one or more ports 110 formed through the uphole collar 108A. Movement of the sleeve's uphole end 116 alternately uncovers or blocks the ports 110 to open or close the ports 110 respectively. As shown in FIGS. 4A and 5A, in the closed position, which is the port-closed uphole position in the context of a ported sub, the uphole end 116 of the sleeve 114 blocks the ports 110.

Figure 4B:
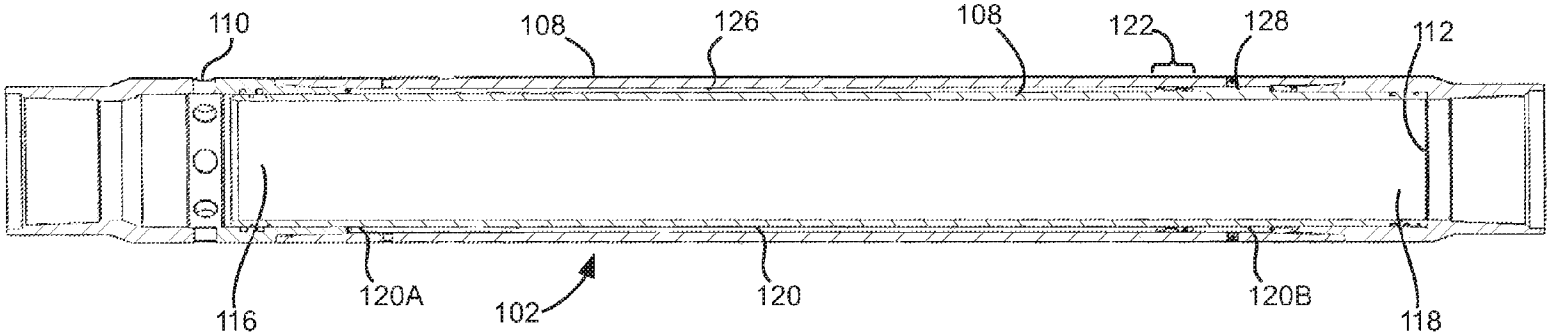
FIG. 4B is a cross-sectional view of the ported sleeve sub of FIG. 4A, wherein the sleeve is in actuated downhole or port-open position.
Figure 5B:
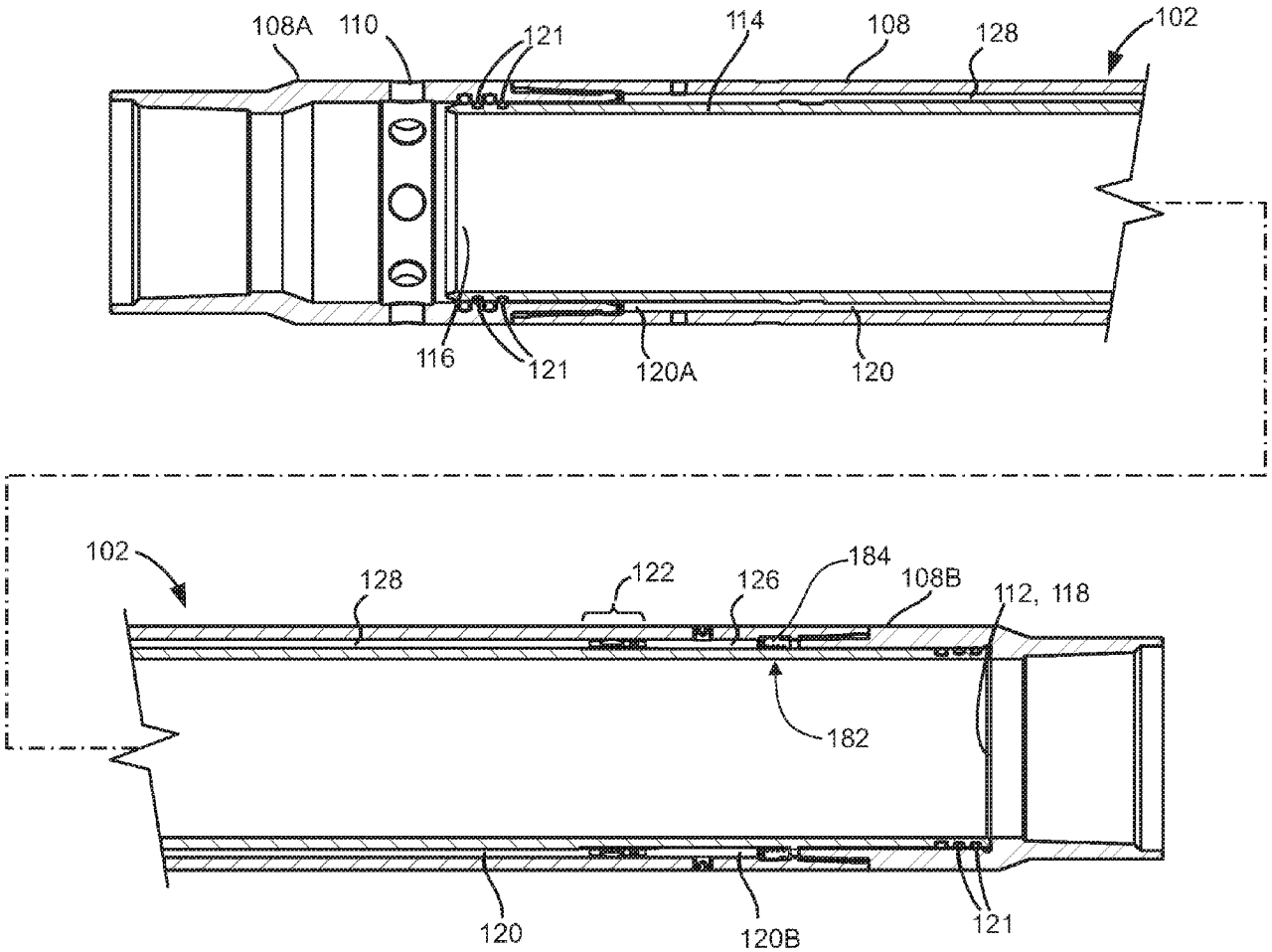
FIG. 5B illustrates more detailed partial sectional views of the port end and stop end of the sleeve sub of FIG. 5A with the sleeve in the open position.

As shown in FIGS. 4B and 5B, when the shifting sleeve 114 moves axially downhole to the open position, which is the port-open downhole position in the context of a ported sub, the uphole end 116 moves entirely downhole of the ports 110 to uncover the ports 110, opening the ports and establishing fluid communication between the inside and outside of the housing 108.

The outer diameter of the sleeve 114 is smaller than the inner diameter of the housing 108, forming an annular space or tool annulus 120 along an intermediate portion of, and between, the housing 108 and sleeve 114. In particular, the tool annulus 120 is located radially between the housing 108 and the sleeve 114 and extends axially from a downhole edge of the uphole collar 108A to an uphole edge of the downhole collar 108B. As the uphole and downhole ends 116 and 118 of the sleeve 114 are moveable within the uphole and downhole collars 108A and 108B, respectively, the tool annulus 120 is an enclosed space with a fixed volume formed at a fixed location with respect to the housing 108 regardless whether the sleeve 114 is at the closed position or at the open position.

The tool annulus 120 is sealed between its uphole end 120A and its downhole end 120B, e.g., by suitable seals such as o-rings 121 between the sleeve's and housing's uphole ends 116 and 108A, and between the sleeve's and housing's downhole ends 118 and 108B.

The shifting sleeve 114 further comprises a circumferential barrier ring 122 coupled thereto for axial movement therewith and slidably sealable against the housing 108. The barrier ring 122 divides the tool annulus 120 into first and second chambers. The first chamber is a downhole chamber 126 located downhole of the barrier ring 122, between the barrier ring 122 and the downhole end 120B of the annulus 120. The second chamber is an uphole chamber 128 located uphole of the barrier ring 122, between the barrier ring 122 and the uphole end 120A of the annulus 120. In this embodiment, the barrier ring 122 is fixed to the sleeve 114 at an axial position closer to the downhole end 118. Accordingly the first chamber 126 has a volume smaller than that of the second chamber 128.

The first and second chambers 126 and 128 are substantially filled with dampening fluid F such as a grease. Preferably, the dampening fluid F has high viscosity and has a high melting temperature, e.g., 200° C., such that it remains "solid" in typical downhole environment. The dampening fluid F preferably has a viscosity index between 80 and 110. In this embodiment, the dampening fluid F is the OG-H™ Open Gera Lubricant with viscosity index of 90, manufactured by Jet-Lube of Edmonton, Alberta, Canada.

As will be described in more detail later, one or more metering passages are formed across the barrier ring 122 to fluidly connect the first and second chambers 126 and 128. The metering passages have restricted cross-section to control the rate of the dampening fluid flowing therethrough and thus control the movement of the sleeve. When the sleeve 114 moves axially along the housing 108, e.g., from the uphole closed position (see FIGS. 4A, 5A) to the downhole open position (see FIGS. 4B, 5B), the barrier ring 122 moves therewith, acting as a piston and attempting to reduce the volume of the first chamber 126 from a first or initial volume when the sleeve 114 is in the uphole position to a smaller actuated volume, pressurizing the grease therein.

Like other liquids, grease is substantially incompressible and when pressurized, retains its volume. Therefore, to enable movement of the sleeve 114 at all, when pressurized, the dampening fluid F in the first chamber 126 is metered through the metering passages to the second chamber 128 at a purposefully limited streamflow rate.

During wellbore completion operation, the sleeve 114 is moved downhole from the first position shown in FIG. 4A to the second position shown in FIG. 4B to open the ports 110. As the axial ends 120A and 120B of the annulus 120 are fixed with respect to the housing 108, the position and the volume of the entire annulus 120, i.e., the union of the first and second first chambers 126 and 128, is unchanged.

However, as the barrier ring 122 is moving downhole with the shifting sleeve 114, the volume of the first chamber 126 between the barrier ring 122 and the annulus downhole end 120B is reduced while the volume of the second chamber 128 between the annulus uphole end 120A and the barrier ring 122 is simultaneously increased. The second chamber 128 is then capable of receiving the displaced dampening fluid F from the first chamber 126. The pressurization of the dampening fluid F in the first chamber 126 hydraulically arrests the movement of the sleeve 114 and dampens any shock caused when the sleeve 114 is stopped by the shoulder 112. The metering passages connecting the first and second chambers 126 and 128 meters the dampening fluid F out of the first chamber 126 into the second chamber 128, allowing the volume of the first chamber 126 to reduce such that the sleeve 114 can move to the downhole open position. With this design, the speed of the sleeve movement is then controlled, and the stopping of the sleeve at the second position would not cause damaging impact.

The overall fluid flow capacity of the metering passages, the volume of at least the first chamber 126 and the flow characteristics of the dampening fluid F such as a viscosity of the fluid relative to wellbore temperature determine the sleeve movement and shock absorption. The dampening occurs as the fluid is pressurized and caused to extrude past the barrier ring 122 via the metering passages 144 from the first chamber 126 to the second chamber 128.

The details of the barrier ring 122 and the metering passages are now described.

Figure 6:
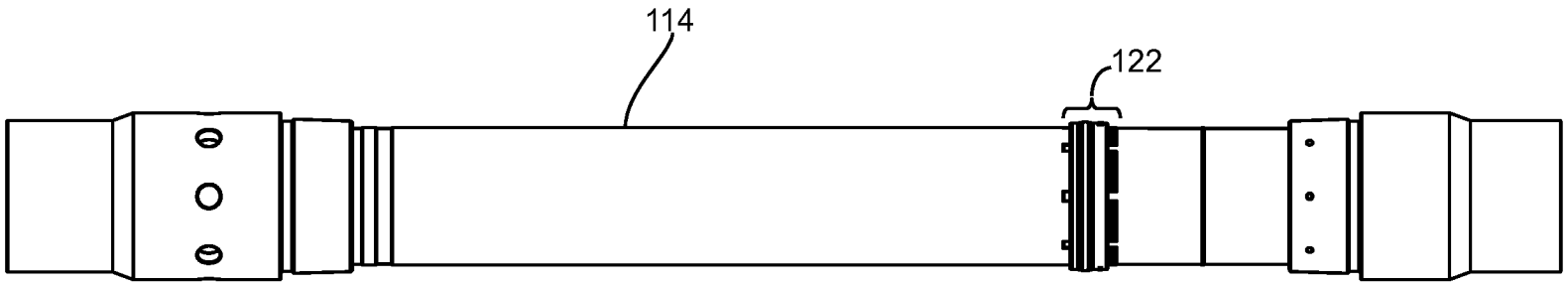
FIG. 6 is a side view of the sleeve sub of FIG. 4A, the housing having been omitted for clarity and illustrating a seal arrangement and metering passages formed about an external surface of the sleeve.
Figure 7A:
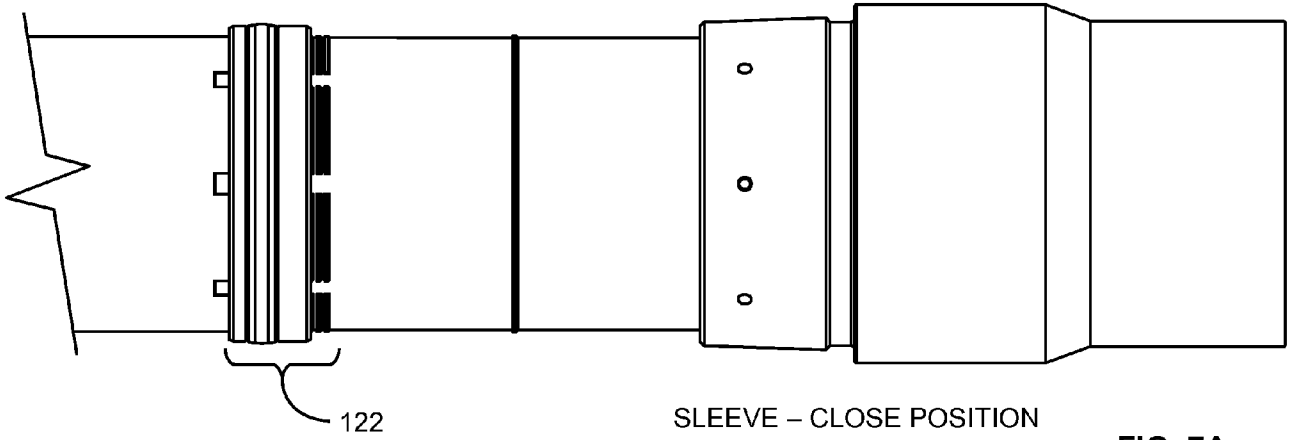
FIGS. 7A and 7B are partial views of the seal arrangement and metering passages of FIG. 6, wherein in FIG. 7A the sleeve is shown in the uphole closed position, the downhole end spaced from the housing stop, and FIG. 7B the sleeve is shown in the downhole open position, the downhole end engaging the housing stop.
Figure 7B:
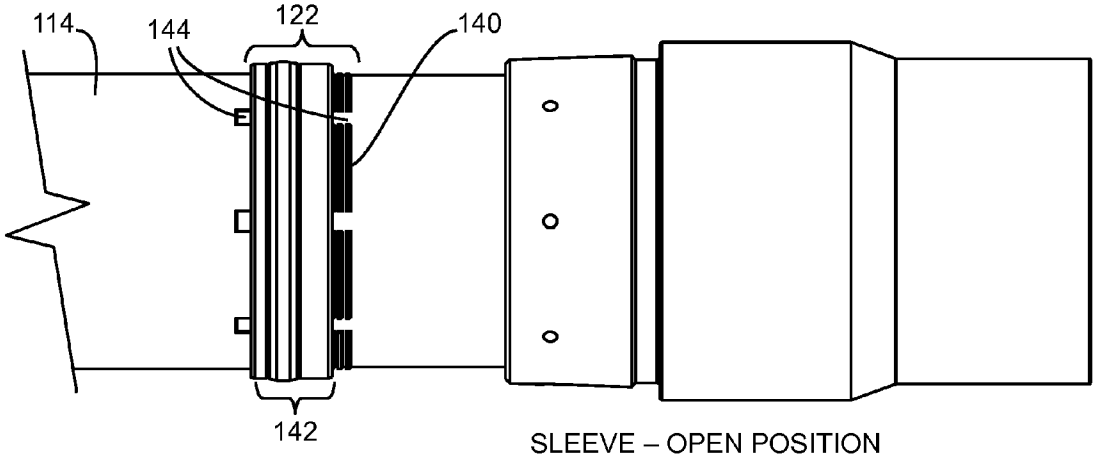
Figure 8:
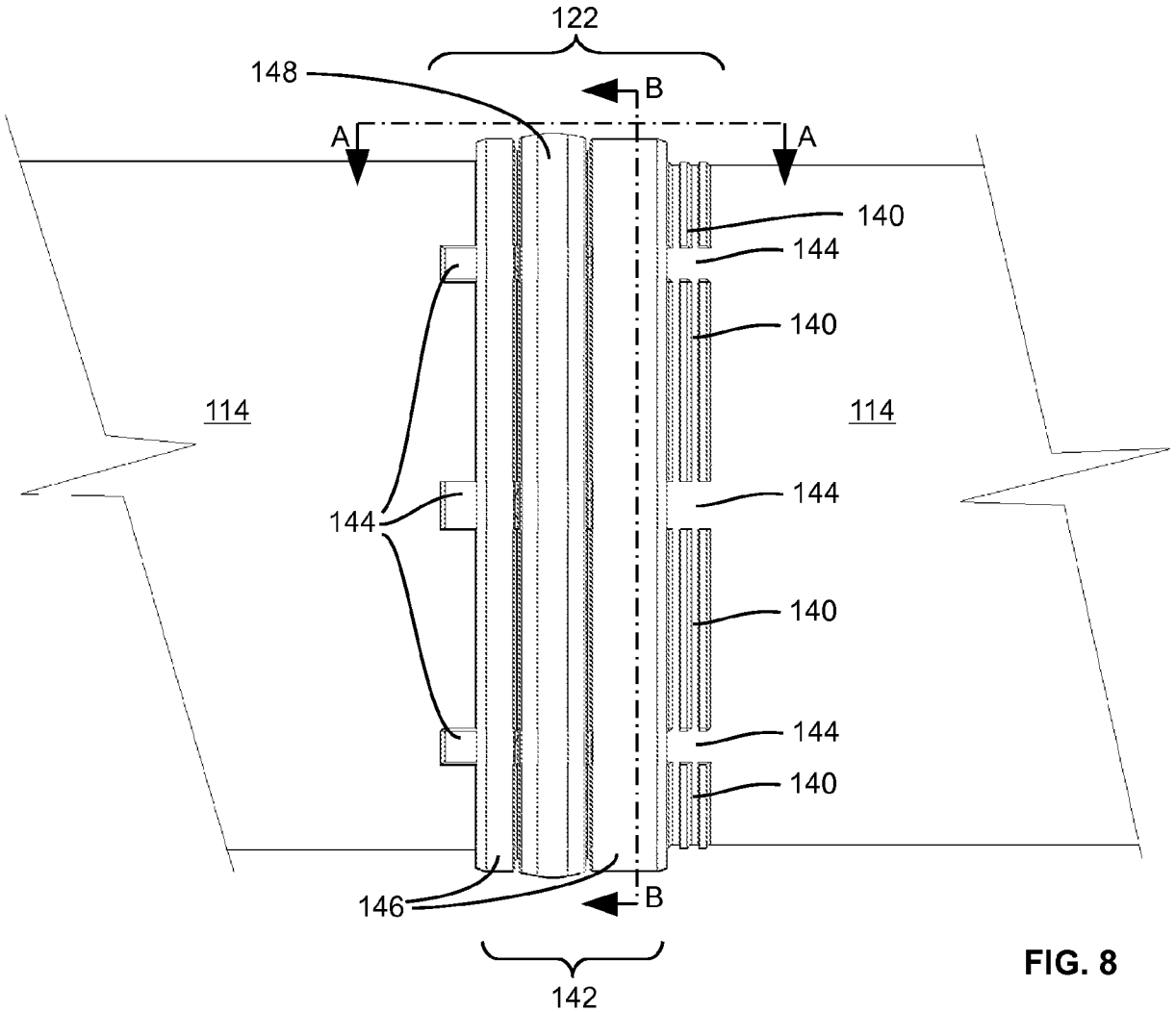
FIG. 8 illustrates one embodiment of the seal arrangement on the sleeve, a barrier ring threadably installed to the sleeve and a plurality of metering passages formed at least axially through the threads, the metering passages permitting fluid to extrude past the barrier ring during shifting of the sleeve and acting to slow the sleeve.

As shown in FIGS. 6 to 8, the barrier ring 122 provides a circumferential seal arrangement 142 threadably coupled onto a plurality of threads 140 on the outer surface of the sleeve 114 for sealing between the sleeve 114 and the housing 108. A plurality of metering passages 144 are provided for fluidly connecting the first and second chambers 126 and 128. The metering passages 144 provides fluid passages past the barrier ring 122.

Figure 9B:
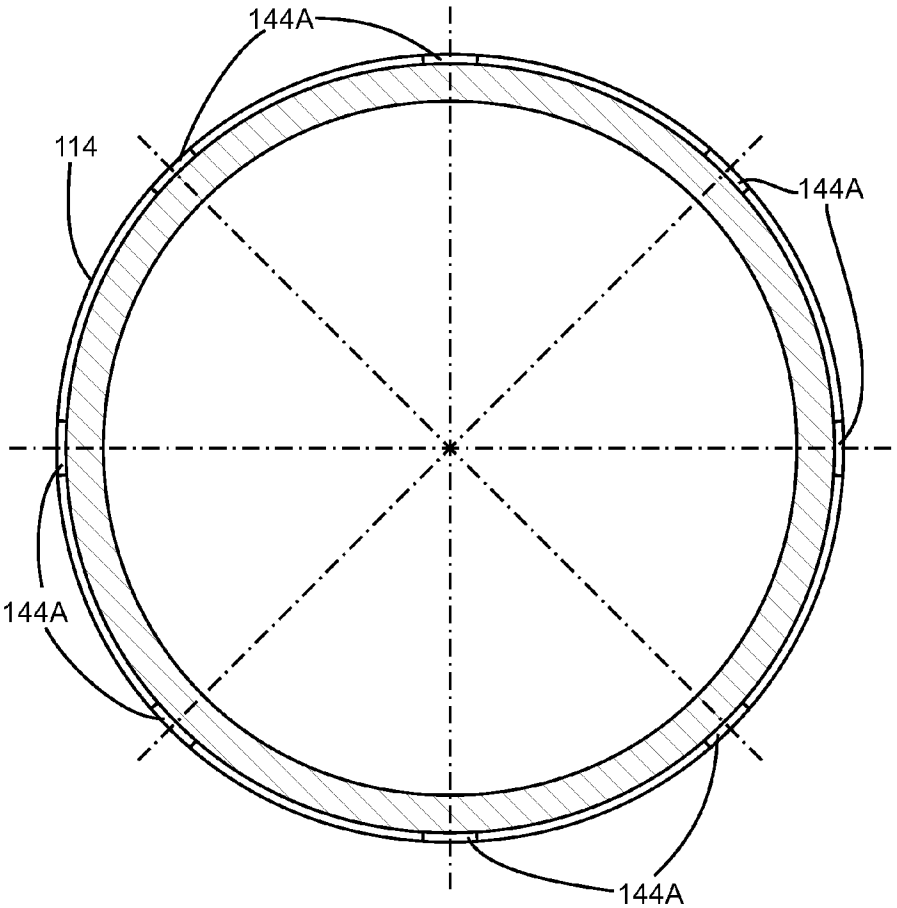
FIGS. 9A and 9B are partial side view and end cross-sectional views of the sleeve of FIG. 8 along sections A-A and B-B, respectively, the seal and retaining ring having been removed for clarity, the sleeve having at least one metering passage formed axially along an outside surface thereof.
Figure 9A:
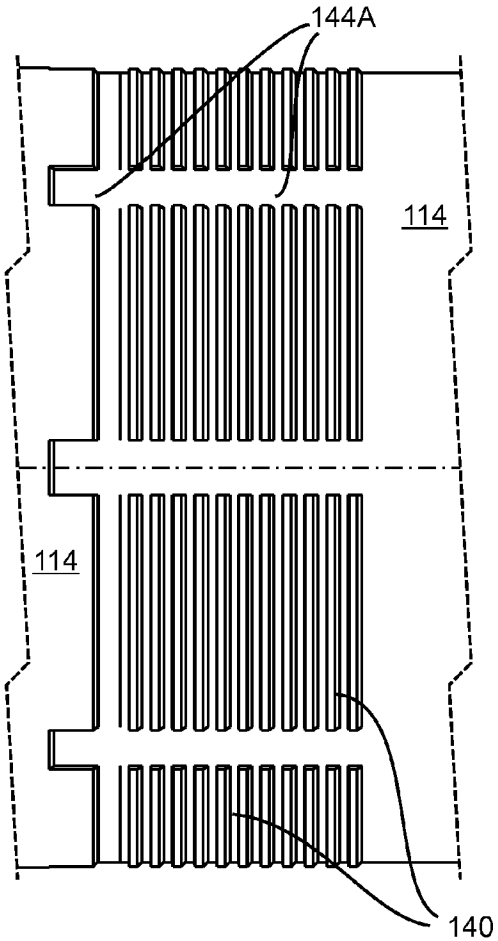

In this embodiment, the metering passages 144 includes passages through the interface of the sleeve and the barrier ring, wherein the passages are on both sides of the sleeve/barrier ring interface. As shown in FIGS. 9A and 9B, an exterior portion of the shifting sleeve 114, from an axial location corresponding to about barrier ring 122 and extending along the first chamber 126, is machined to a smaller diameter including a plurality of upstanding external threads 140.

A plurality of spaced grooves 144A are formed on the outer surface of the sleeve extending generally axially through the threads 140. Accordingly, the external threads 140 are circumferentially discontinuous, interrupted circumferentially by the spaced grooves 144A.

Figure 9D:
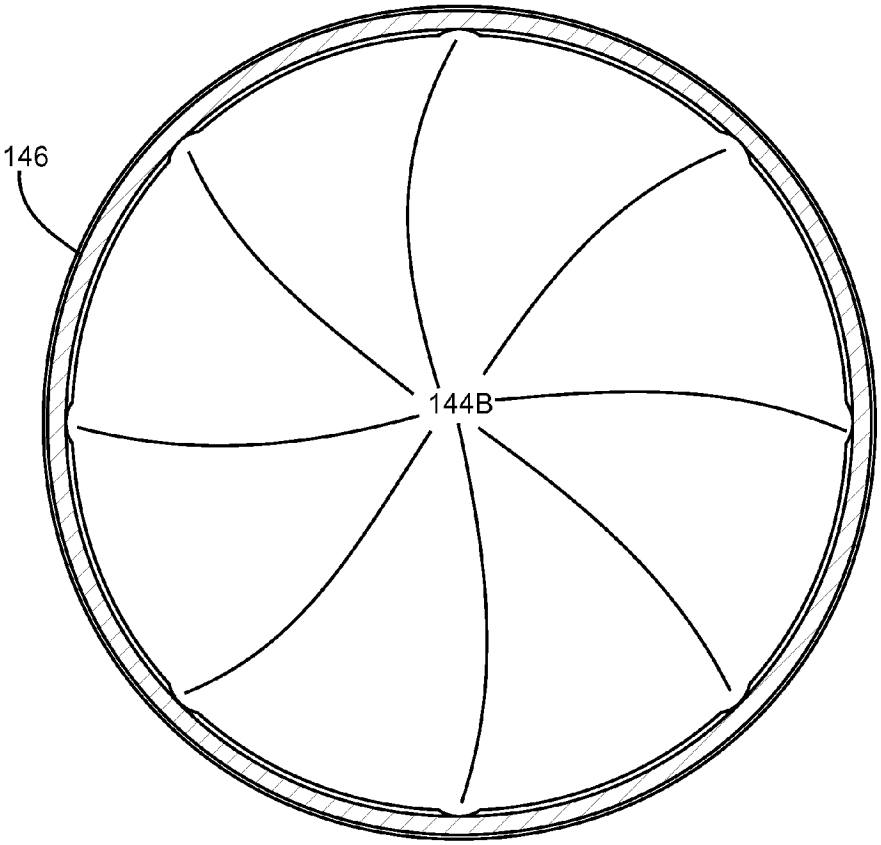
FIGS. 9C and 9D are side and end cross-sectional views of the barrier ring of FIG. 8 taken along sections A-A and B-B, respectively, the sleeve having been omitted for clarity, the ring also having at least one metering passage formed axially along and inside surface thereof.
Figure 9C:
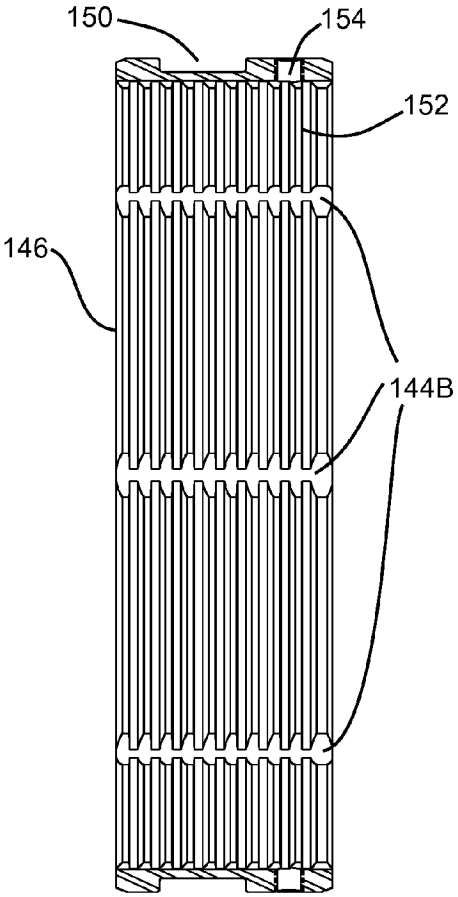

Referring again to FIG. 8 the seal arrangement 142 comprises a retaining ring 146 and an annular seal 148 extending circumferentially about an outer surface of the retaining ring 146. As shown in FIGS. 9C and 9D, the retaining ring 146 has an annular groove 150 thereabout for receiving the seal 148. The seal 148 provides sufficient displacement to maintain a seal to the housing 108 despite normal variances in manufacturing tolerances. A plurality of threads 152 are machined on the inner surface of the retaining ring 146 for threading the retaining ring 146 onto the threads 140 on the sleeve 114.

The internal threads are also formed with axially-aligned, circumferentially periodic discontinuities for forming additional and generally axially-extending grooves 144B. In this embodiment, the number and locations of the grooves 144B on the inner surface of the retaining ring 146 match those of the grooves 144A on the outer surface of the sleeve 114. The retaining ring 146 further comprises a one or more set screw holes 154 extending radially therethrough for releasable engagement with the sleeve, a set screw engaged with hole 154, locking the rotational position thereof when the retaining ring 146 is threaded onto the sleeve 114.

Figure 9E:
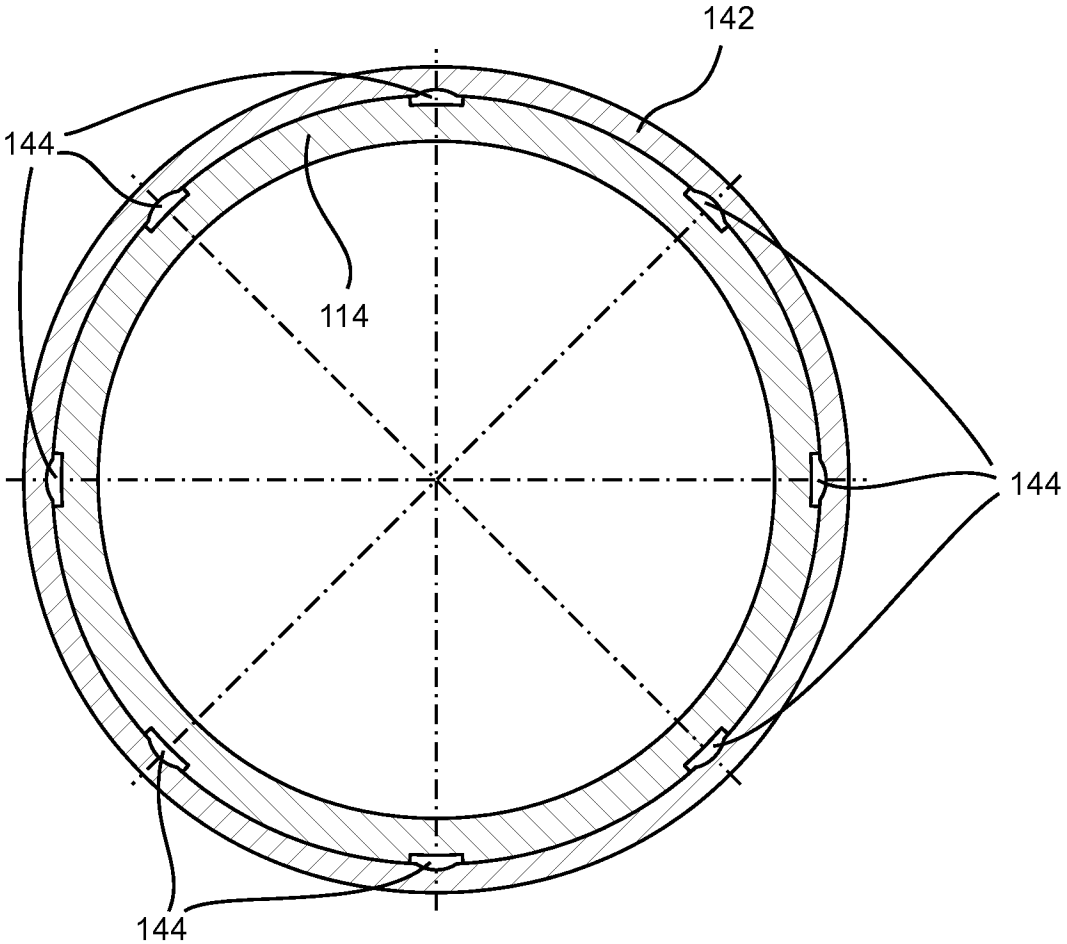
FIG. 9E is an end cross-sectional view of the sleeve and seal arrangement illustrating rotational alignment of the respective outside and inside surface metering passages for increased flow metering capacity.

As shown in FIG. 9E, after the internal threads 152 of the seal arrangement 142 are threaded onto the external threads 140 (not shown therein) of the sleeve 114, set screw is coupled to sleeve 114, along the set screw hole 154, with one of the axially-extending grooves 144A so as to align each groove 144A on the outer surface of the sleeve 114 with a corresponding groove 144B on the inner surface of the retaining ring 146, each pair of grooves 144A and corresponding grooves 144B forming one of the plurality of metered passages 144 that fluidly connecting the first and second chambers 126 and 128. The size and number of the metered passages 144 are chosen such that the fluid in the first chamber 126, when pressurized, flows to the first chamber 126 at a metered and limited streamflow rate.

In this embodiment, for pressure equalization of both chambers during run-in operations, the second chamber 128 further comprises an open port 124 adjacent to its uphole end, opposite to the barrier ring 122.

A breakdown of cement in an annulus between the sleeve sub and the casing and about the ports, as the sleeve rapidly shifts past the ports, is desirable and can be determined as a weight drop at surface, however in embodiments disclosed herein the rapid breakdown is balanced with the dampening of the sleeve speed.

In this embodiment, the sleeve 114 also comprises an angled end surface for further reducing damages that may be caused by the impact of stopping the sleeve 114 on the shoulder 112.

Figure 10A:
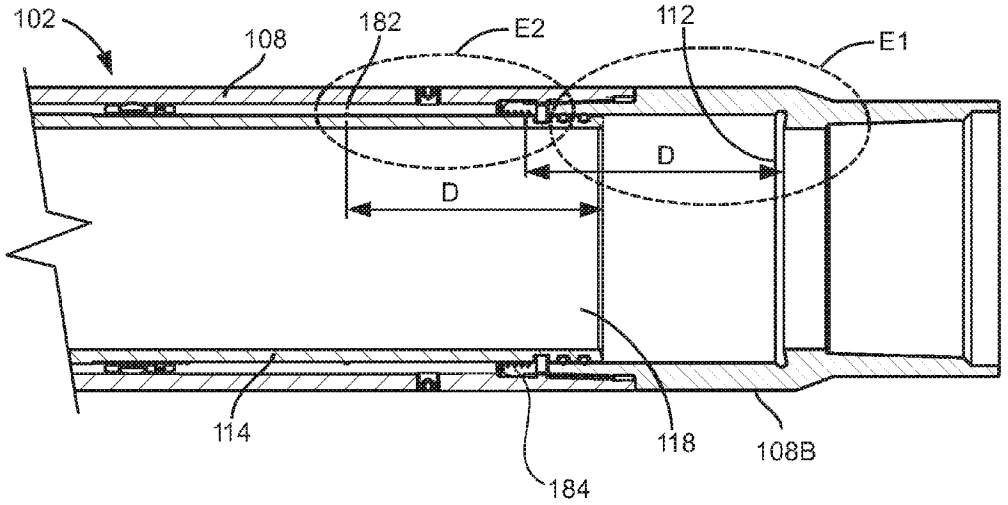
FIG. 10A illustrates a partial sectional view of the downhole stop end of the sleeve sub of FIG. 4A with the sleeve in the closed position.
Figure 10B:
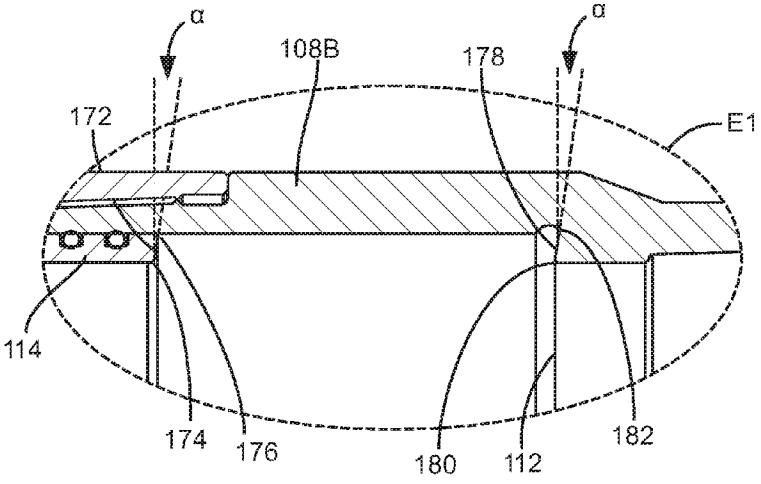
FIG. 10B shows an enlarged view of area E1 of FIG. 10A.

As shown in FIGS. 10A and 10B, the downhole end surface 172 of the sleeve 114 extends from the annular inner edge 174 axially outwardly to the annular outer edge 176 with an acute angle $\alpha$. The shoulder 112 is also machined to form an angled annular surface 178 corresponding to the angled downhole end surface 172 of the sleeve 114, i.e., the annular surface 178 extending from its annular inner edge 180 axially inwardly to its outer edge 182 with an acute angle $\alpha$.

Figure 10C:
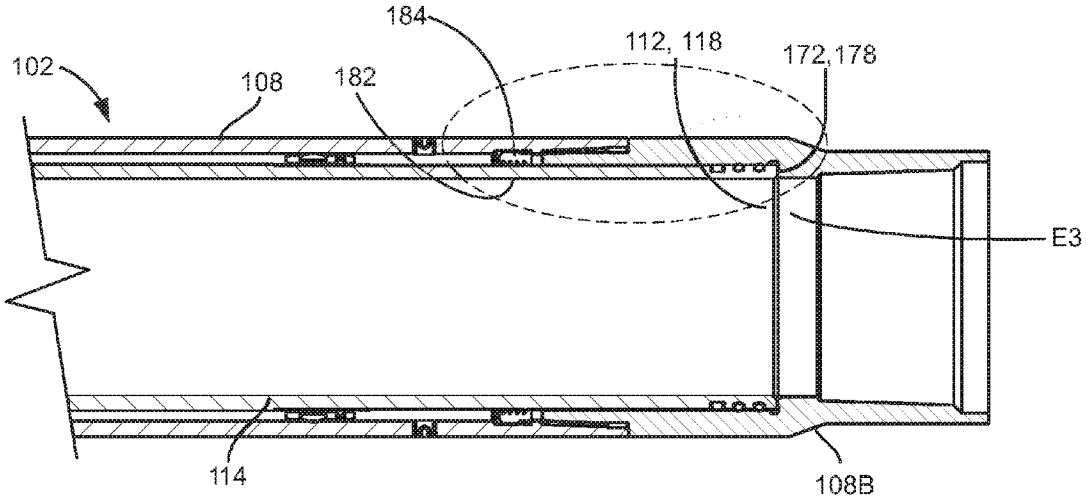
FIG. 10C illustrates a partial sectional view of the downhole stop end of the sleeve sub of FIG. 4A with the sleeve in the open position.
Figure 10D:
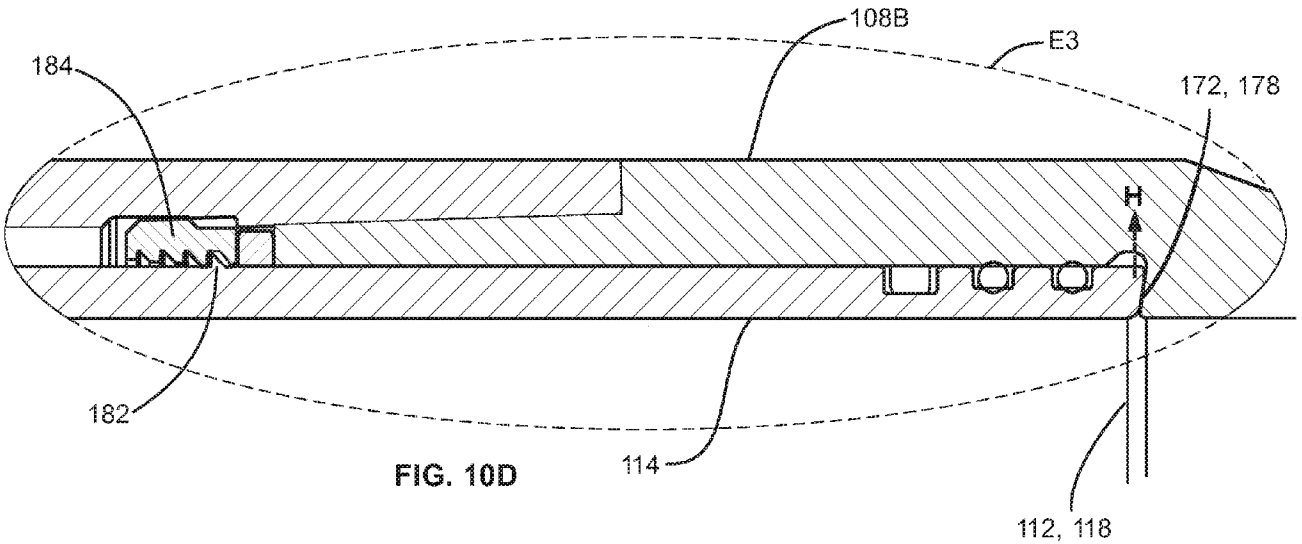
FIG. 10D shows an enlarged view of area E3 of FIG. 10C.
Figure 10E:
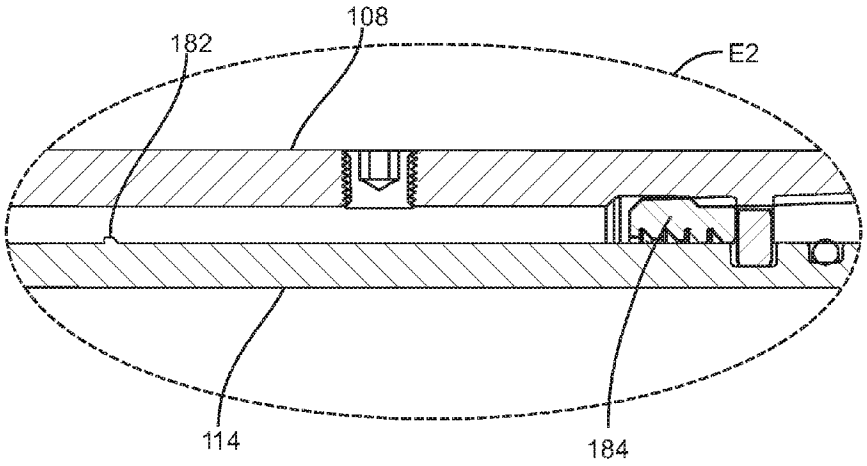
FIG. 10E shows an enlarged view of area E2 of FIG. 10A.

As shown in FIGS. 10C and 10D, when the sleeve 114 is moved from the closed position downhole to the open position, the angled annular end surface 172 of the sleeve 114 hits and rests against the angled annular surface 178 of the shoulder 112, causing the angled annular surface 178 of the shoulder 112 to apply an radially outward force H to the end surface 172 of the sleeve 114. Such a radially outward force H avoids what could otherwise be a radially inward distortion of the downhole end of the sleeve 114, and damage associated therewith.

The sleeve sub 102 also comprises a restraining mechanism. Referring to FIGS. 10A and 10C, the sleeve 114 further comprises an annular tab 182 extruding radially outwardly from the outer surface of the sleeve 114 axially at a location adjacent the downhole end with a distance D therefrom. Correspondingly, the downhole collar 108B also comprises one or more annular serrated grippers 184 in the form of one or more grooves on the inner surface thereof at a location with a distance D from the shoulder 112.

When the sleeve 114 is moved from the first position downhole to the second position, the momentum of the sleeve 114 forces the tab 182 to engage one of the serrated grippers 184 to restrain the sleeve 114 at the second position. The restraint can be overcome with a suitably forceful actuation.

In this embodiment, the first chamber 126 has a length of about 6 inches and an annular thickness of about 0.2 inch. The second chamber has a length of about 24 inches and an annular thickness of about 0.18 inch. Each of the passages 144A shown in FIGS. 9A and 9B has a width of about 0.3 inch and a depth of about 0.03 inch. Each of the passages 144B shown in FIGS. 9C and 9D has a width of about 0.26 inch and a maximum depth of 0.04 inch.

Those skilled in the art appreciate that, in various embodiments, the sleeve 114 may actuated by various means, and may be actuated to move downhole, uphole or in both directions.

Figure 11:
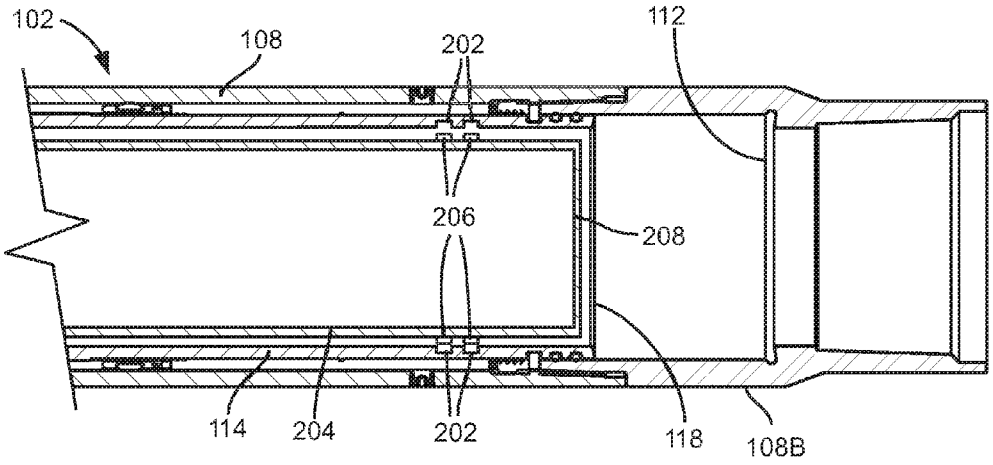
FIG. 11 shows a partial sectional view of the downhole stop end of the sleeve sub and a shifting tool received therein, according to an alternative embodiment.

For example, as shown in FIG. 11, in one embodiment, the sleeve 114 further comprises one or more annular gripping grooves 202 spaced axially on its inner surface at an axial location uphole of and adjacent the downhole end 118 of the sleeve. A shifting tool 204 in the form of a tubular having an outer diameter generally equal to or slightly smaller than the inner diameter of the sleeve 114 comprises a plurality of keys 206 correspondingly spaced on its outer surface adjacent the downhole end 208 at locations corresponding to the gripping grooves 202.

To move the sleeve 114, the shifting tool 204 is first inserted into the sleeve 114 and positioned at a predefined location such that the keys 206 on the shifting tool 204 are aligned to respective gripping grooves 202 on the sleeve 114. Then, the keys 206 are forced out to axially engage the gripping grooves 202 to hold the sleeve 114. Alternatively, the keys 206 are biased or otherwise actuated to engage the gripping grooves 202. Another force such as a hydraulic force is applied to move the shifting tool 204 and the sleeve 114 downhole towards the second position. Those skilled in the art appreciate that a force may alternatively be applied to move the shifting tool 204 and the sleeve 114 uphole from a downhole position.

In another embodiment, the sleeve 114 does not comprise gripping grooves. Rather, the annular end surface 172 is configured to be engaged by the keys 206, such as to be radially "thicker" than that of the annular surface 178 of the shoulder 112, such that, when the annular end surface 172 rests against the shoulder surface 178, a radially inner portion of the end surface 172 is exposed out of the shoulder surface 178.

To move the sleeve 114, a shifting tool 204 comprising a plurality of keys 206 annually distributed on its outer surface adjacent the downhole end 208 is first inserted into the sleeve 114 and positioned such that the keys 206 on the shifting tool 204 are downhole to the sleeve's end surface 172. Then, the keys 206 are forced out to axially engage the portion of the end surface 172 that is exposed out of the shoulder 112. Another force such as a hydraulic force is applied to move the shifting tool 204 and the sleeve 114 uphole. In this embodiment, the shifting tool 204 can only "pull back" the sleeve uphole from a downhole position to an uphole position.

Those skilled in the art appreciate that other embodiments are also readily available. For example, those skilled in the art appreciate that the above-mentioned shock absorbing mechanism using the first and second annular chambers 126 and 128, the damage prevention mechanism using the angled end surface 172 of sleeve 114 and the angled surface 178 on the shoulder 112, and the restraining mechanism comprising the annular tab 182 and the serrated grippers 184 do not have to be used together. A designer may choose to use any one or any combination of these mechanisms as needed.

In one embodiment, the sleeve 114 comprises a plurality gripping grooves adjacent the uphole end 116. Correspondingly, a shifting tool 204 comprises a plurality of keys 206 for axially engaging the gripping grooves adjacent the uphole end 116 to move the sleeve 114 uphole or downhole in a manner similar as described above. In another embodiment, the housing 108 comprises an uphole shoulder at its uphole end with an annular surface radially "thinner" that the uphole end surface of the sleeve such that a radially inner portion of the sleeve's uphole end surface may be exposed out of the housing's uphole shoulder surface when the sleeve is at an uphole position.

To move the sleeve 114, a shifting tool comprising a plurality of keys annually distributed on its outer surface adjacent its uphole end is first inserted into the sleeve 114 and positioned such that the keys 206 on the shifting tool 204 are uphole to the sleeve's uphole end surface. Then, the keys are forced out to axially engage the portion of the uphole end surface that is exposed out of the housing's uphole shoulder. Another force such as a hydraulic force is applied to move the shifting tool and the sleeve downhole. In this embodiment, the shifting tool 204 can only "push" the sleeve uphole from an uphole position to a downhole position.

In some alternative embodiments, the uphole end 116 of the sleeve 114 comprises one or more ports (not shown) corresponding to ports 110 on the uphole collar 108A. When the sleeve 114 is in the closed position, the uphole end 116 of the sleeve 114 blocks the ports 110. When the sleeve 114 moves axially downhole to the open position, the ports on the uphole end of the sleeve 114 is aligned with respective ports 110 on the uphole collar 108A, opening the ports and establishing fluid communication between the inside and outside of the housing 108.

Those skilled in the art appreciate that the axially-extending metering passages 142 may be formed in a variety of different ways in alternative embodiments. FIGS. 12A to 12D show some examples.

Figure 12B:
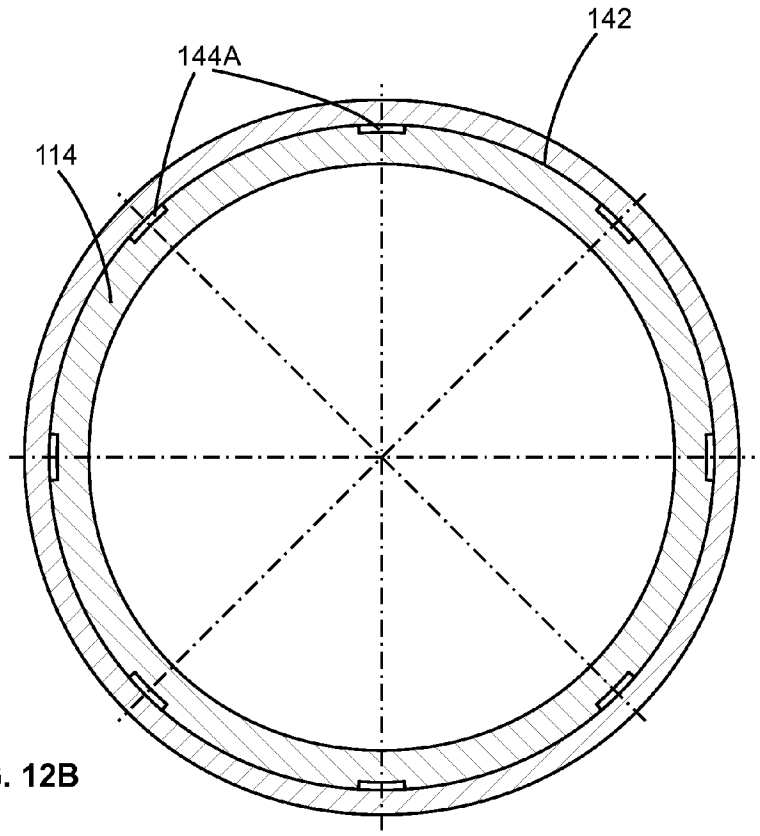
FIGS. 12A to 12D are end cross-sectional views of alternative embodiments of the sleeve and seal arrangement, wherein FIG. 12A having misaligned sleeve and ring metering passages, FIG. 12B having metering passages formed only in the sleeve, FIG. 12C having metering passages formed along the inside surface of the barrier ring, and FIG. 12D having metering passages formed through the body of the ring.
Figure 12A:
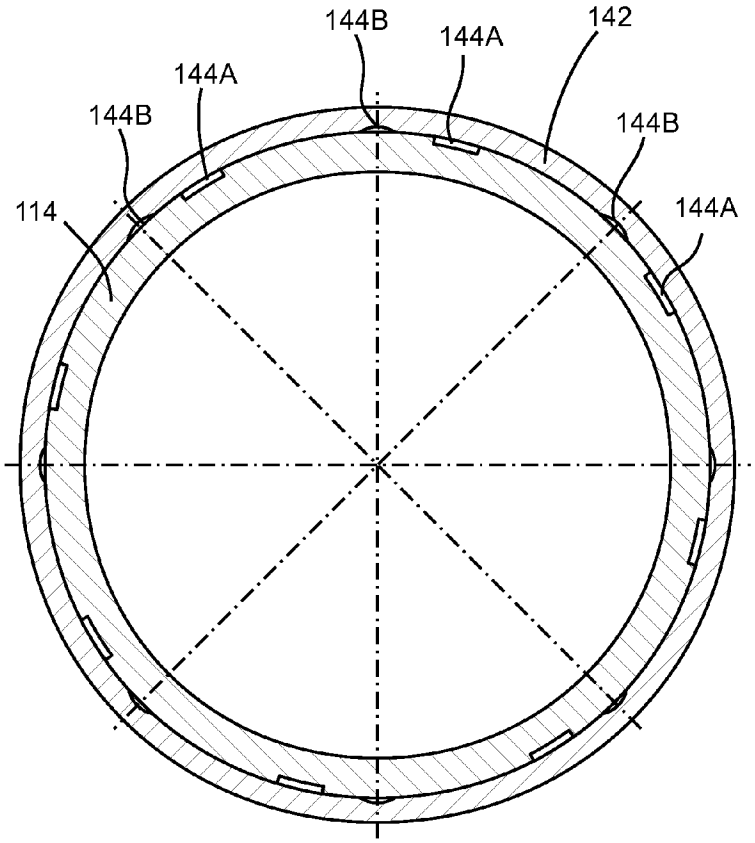

As shown in FIG. 12A, in an alternative embodiment, the seal arrangement 142 is set to an angular position that the passages 144B on its inner surface are not aligned with the passages 144A on the outer surface of the sleeve 114. In this embodiment, the metering passages 144 for fluidly connecting the first and second chambers 126 and 128 include the passages 144A on the sleeve side of the interface between the sleeve 114 and the barrier 122 (or more specifically the seal arrangement 142), and passages 144B on the barrier side of the interface between the sleeve 114 and the barrier 122.

As shown in FIG. 12B, in another embodiment, the sleeve 114 is profiled to have the passages 144A as described above. However, the internal threads 152 on the inner surface of the seal arrangement 142 are circumferentially continuous, i.e., the seal arrangement 142 does not comprise any passages. In this embodiment, the metering passages 144 for fluidly connecting the first and second chambers 126 and 128 only include the passages 144A on the sleeve side of the interface between the sleeve 114 and the barrier 122.

Figure 12D:
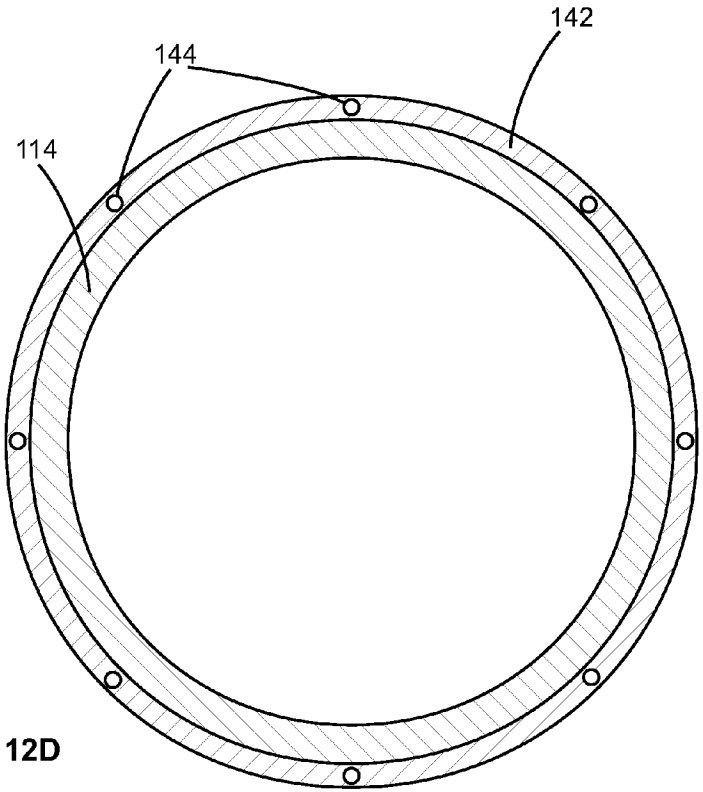
Figure 12C:
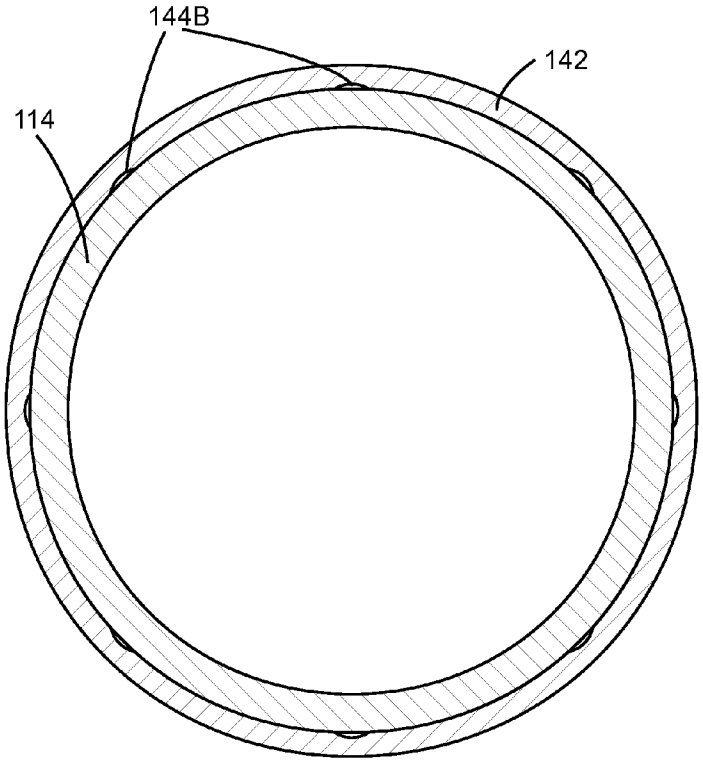

As shown in FIG. 12C, in yet another embodiment, the seal arrangement 142 is profiled to have the passages 144B as described above, but the sleeve 114 does not comprise any passages. In this embodiment, the metering passages 144 for fluidly connecting the first and second chambers only include the passages 144B on the barrier side of the interface between the sleeve 114 and the barrier 122.

As shown in FIG. 12D, in still another embodiment, the metering passages 144 are formed as passages extending through the body of the seal arrangement 142.

In above embodiments, a plurality of metering passages 144 are formed generally axially across the seal arrangement 142. However, those skilled in the art appreciate that, in some alternative embodiments, the shifting sleeve 114 may comprise only one metering passage 144 generally axially across the barrier ring 122.

In some embodiments, should the sleeve be actuated from the downhole to the uphole position, the uphole movement can be similarly dampened as the dampening fluid F is metered back through the metering passages 144 from the second chamber 128 to the first chamber 126. In these embodiments, the second chamber 128 does not comprise the open port 124.

So as to manipulate the relative dampening for a downhole sleeve movement versus an uphole movement, the second chamber 128 can be substantially filled with a second dampening fluid such as a second type of grease. Thus, where the first type of fluid filling the first chamber 126 is different from the second type of fluid filling in the second chamber 128, the extent of dampening will also differ. Where the first and second dampening fluids are same, the dampening will be similar. Note that when the fluids are different, repeated downhole and uphole actuation will result in a mingling of the fluids and an eventual equilibration of the dampening effects.

The above embodiments allow one to manufacture the sleeve sub 102 using off-the-shelf products that may have loose tolerance. The seal 148 added to the barrier ring 122 is such an accommodation. In situations that one may control the components of the sleeve subs 102 to achieve fine tolerance as required, some alternative embodiments described below may be used.

In another embodiment, the uphole and downhole ends 120A and 120B of the annulus 120 are formed by an upset in diameter of respective housings' ends 108A,108B, decreasing in diameter from the housing 108 to seal surfaces, corresponding to the seal surfaces of the sleeve's ends 116,118. The annulus uphole end 120A is sufficiently spaced downhole from the ports 110 such that the sleeve's uphole end 116 remains sealed to the housings uphole end 108A in the downhole closed position.

In an alternative embodiment, albeit using more seals than previous embodiments, the annulus 120 can be sealed axially at its uphole and downhole ends and fixed with respect to the sleeve 114. The barrier ring 122 is coupled to the inner surface of the housing 108 at a location fixed therebetween. The barrier ring 122 is in sealable contact with the outer surface of the sleeve 114, and divides the annulus 120 into a first chamber uphole to the barrier ring 122 and a second chamber downhole thereto. Similar to the embodiments above, one or more metering passages are formed in or under the barrier ring 122 for fluidly connecting the first and second chambers. A first type dampening fluid is enclosed in the first chamber and a second type fluid is dampening enclosed in the second chamber.

In well completion operation, when the sleeve 114 is shifted downhole to open the ports 110, the spaced and sealed uphole and downhole ends of the annulus 120 are shifted downhole with the sleeve 114. As the seal arrangement 122 is not moving, the first chamber is then pressurized causing the fluid therein to flow into the second chamber through metering passages across the barrier ring 122. The pressurization of the fluid in the first chamber dampens the impact to the sleeve 114.

In some other embodiments, the annulus 120 may be divided by a plurality of barriers into more than two chambers. One or more metering passages are formed across each barrier such that the chambers are fluidly connected. The chambers may be substantively filled with the same type or different types of dampening fluid such as grease.

In an alternative embodiment, the annulus 120 is a contiguous space, i.e., not divided. The downhole end 120B is sealably coupled to the housing 108 and the uphole end 120A is sealably coupled to the sleeve 144. The annulus space 120 is filled with a compressible fluid such as Nitrogen. When the sleeve 114 is moving axially from the first position downhole to the second position, the position of the downhole end 120B is unchanged while the position of the uphole end 120A is axially moving towards the downhole end 120B. The volume of the annulus 120 is then reduced, compressing the compressible fluid therein. As a result, the compressed fluid dampens the impact caused by the stopping of the sleeve 114.

Although in above embodiments, the seal arrangement 142 is threaded to a plurality of threads on the outer surface of the sleeve 114, in some other embodiments, the seal arrangement 142 is fixed to the sleeve 114 using other suitable means such as welding, glue or other suitable fasteners. In these embodiments, the metering passages across the barrier ring 122 may be within the seal arrangement 142.

Although in above embodiments, one or more barrier rings 122 are used for sealably dividing the annulus 120 into two or more chambers, in some alternative embodiments, the barrier rings 122 divide the annulus 120 into chambers in an unsealed manner and leave an annular gap for fluidly connecting the chambers. The gap may be carefully designed to achieve desired fluid flow capacity for controlling shock absorption.

Figure 13A:
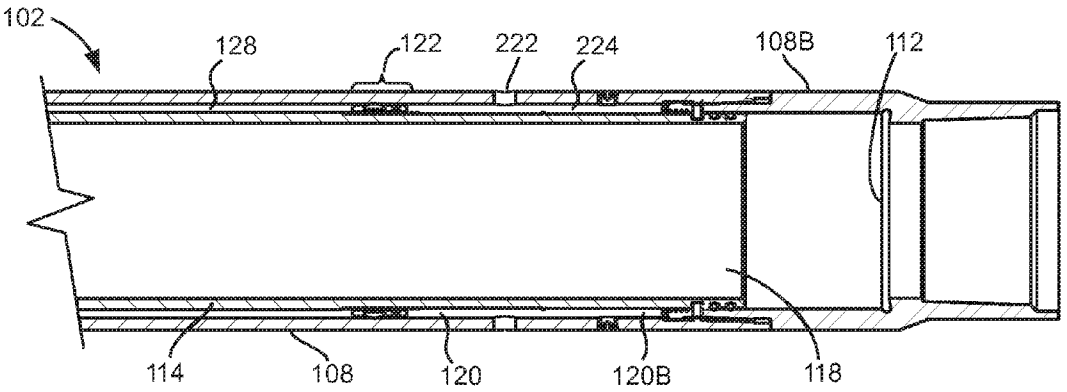
FIG. 13A illustrates a partial sectional view of the downhole stop end of the sleeve sub having one or more metering passage through the housing, according to an alternative embodiment.

In an alternative embodiment shown in FIG. 13A, the sleeve sub 102 does not comprise any passage across the barrier ring 122. Rather, one or more metering passages 222 are formed through the housing 108 at a location or locations corresponding to the first chamber 224 for controllably releasing the dampening fluid F out of the first chamber 224 into the exterior of the sleeve sub 102 when the volume of the first chamber 224 is reduced during the movement of the sleeve.

Figure 13B:
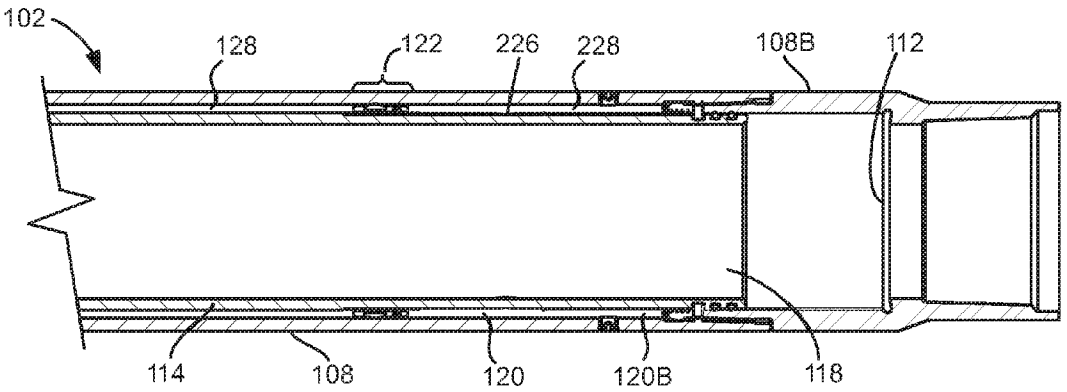
FIG. 13B illustrates a partial sectional view of the downhole stop end of the sleeve sub having one or more metering passage through the sleeve, according to another embodiment.

In an alternative embodiment shown in FIG. 13B, the sleeve sub 102 does not comprise any passage across the barrier ring 122. Rather, one or more metering passages 226 are formed through the sleeve 114 at a location or locations corresponding to the first chamber 228 for controllably releasing the dampening fluid F out of the first chamber 228 into the interior of the sleeve 114 when the volume of the first chamber 228 is reduced during the movement of the sleeve.

Those skilled in the art appreciate that in other embodiments, one may form metering passages through any combination of the barrier ring 122, the housing 108 and the sleeve 114 for controllably releasing the dampening fluid out of the first chamber during the movement of the sleeve 114.

What is claimed is:

1. A downhole apparatus comprising:

a tubular housing along a tubing string;

one or more ports in the tubular housing;

a sleeve located within the housing and axially moveable therein from a first closed position wherein the sleeve blocks the one or more ports to a second open position wherein the sleeve moves past the one or more ports to open the ports;

an annular space radially intermediate the housing and the sleeve and located at a fixed location with respect to the housing;

a stop shoulder formed at a downhole end of the housing and extending radially into the annular space for delimiting axial movement of the sleeve at the second open position;

an annular barrier in the annular space, fixed to the sleeve and sealably moveable therewith for dividing the annular space into a first annular chamber and a second annular chamber axially immediately adjacent the first annular chamber, the first annular chamber containing a first, incompressible dampening fluid, the movement of the annular barrier simultaneously reducing the volume of the first chamber and enlarging the volume of the second chamber;

a seal arrangement on the annular barrier for sealing between the sleeve and the housing; and at least one metering passage fluidly connecting the first and second chambers across the seal arrangement, wherein when the sleeve moves from the first closed position to the second open position, the first dampening fluid is pressurized and controllably released through the at least one metering passage to the second chamber for controlling the speed of the sleeve movement toward the stop shoulder.

2. The apparatus of claim 1 wherein the first dampened fluid is grease.

3. The apparatus of claim 1 wherein the first dampened fluid has a viscosity index in the range between 80 and 110.

4. The apparatus of claim 1 wherein the first dampened fluid has a viscosity index of 90.

5. The apparatus of claim 1 wherein the first chamber has a first volume and the second chamber has a second volume, the first volume being smaller than the second volume.

6. The apparatus of claim 1 wherein the second chamber contains a second incompressible dampening fluid.

7. The apparatus of claim 6 wherein the first and second dampening fluids are like fluids.

8. The apparatus of claim 6 wherein the first and second dampening fluids are different fluids.

9. The apparatus of claim 1 wherein the barrier is threadably engaged onto the sleeve for fixing thereto.

10. The apparatus of claim 9 wherein the sleeve comprises exterior threads and the barrier comprises internal threads, the sleeve's exterior threads being circumferentially discontinuous forming the at least one axial metering passage fluidly connecting the first and second chambers across the barrier.

11. The apparatus of claim 9 wherein the sleeve comprises exterior threads and the barrier comprises internal threads, the barrier's internal threads being circumferentially discontinuous forming the at least one axial metering passage fluidly connecting the first and second chambers across the barrier.

12. The apparatus of claim 1 wherein the at least one metering passage extends axially through an interface between the sleeve and the barrier.

13. The apparatus of claim 12 wherein the at least one metering passage is formed on both sides of the interface of the sleeve and the barrier.

14. The apparatus of claim 12 wherein the at least one metering passage is on the sleeve side of the interface of the sleeve and the barrier.

15. The apparatus of claim 12 wherein the at least one metering passage is on the barrier side of the interface of the sleeve and the barrier.

16. The apparatus of claim 1 wherein the at least one metering passage extends axially through the barrier.

17. The apparatus of claim 1 wherein the housing comprises the stop shoulder for receiving an annular end surface of the sleeve when the sleeve is at the second position, wherein the annular end surface of the sleeve extends axially outwardly with a predefined angle from an inner edge thereof to an outer edge thereof, and wherein the stop shoulder of the housing extends axially inwardly with the predefined angle from an inner edge thereof to an outer edge thereof.

18. The apparatus of claim 1 further comprising:

a restraining apparatus operative between the sleeve and the housing for releasably restraining the sleeve to the housing in the second open position.

19. The apparatus of claim 18 wherein the restraining apparatus comprises:

a radially outwardly extending tab formed on an outer surface of the sleeve, the tab located axially a distance from a downhole end thereof; and one or more annular, serrated grippers formed on an inner surface of the housing, located a distance from the downhole end thereof, wherein when the sleeve is shifted axially to engage the stop shoulder, the tab engages in one of the one or more serrated grippers for releasably restraining the sleeve in the second open position.

20. The apparatus of claim 19 wherein the annular serrated grippers comprise one or more annular grooves on the inner surface of the housing.

21. A method of moving a sleeve in a housing located in a tubing string, the housing having one or more ports, the sleeve moving axially from a first closed position wherein the sleeve blocks the ports to a second open position wherein the sleeve is moved axially away from the ports for opening the ports and engages a stop shoulder for delimiting the axial movement therein, said method comprising:

providing an annular space radially intermediate the housing and the sleeve and located at a fixed location with respect to the housing;

positioning an annular barrier having a seal arrangement in the annular space for sealing therein and dividing the annular space into a first annular chamber and a second annular chamber axially immediately adjacent the first annular chamber;

enclosing a first incompressible dampening fluid in the first chamber;

moving the sleeve and the annular barrier connected thereto from the first position to the second position; and during the movement of the sleeve and annular barrier, pressurizing the first dampening fluid in the first chamber, and controllably releasing the pressurized first dampening fluid, through at least one metering passage fluidly connecting the first and second chambers across the annular barrier and seal arrangement, from the first chamber to the second chamber for controlling the speed of the sleeve for engaging the stop shoulder.

* * * * *